United States Patent [19]

Rubinstein et al.

[11] Patent Number: 4,541,260

[45] Date of Patent: Sep. 17, 1985

[54] GUARD PLATE AND ALARM

[76] Inventors: Edward Rubinstein, 3325 Neptune Ave., Brooklyn, N.Y. 11224; Efim Rubinshtein, 2612 West St., Brooklyn, N.Y. 11223

[21] Appl. No.: 393,063

[22] Filed: Jun. 28, 1982

Related U.S. Application Data

[63] Continuation-in-part of Ser. No. 147,623, May 7, 1980, Pat. No. 4,365,491.

[51] Int. Cl.[4] ..... E05B 17/14; E05B 37/12

[52] U.S. Cl. ..... 70/425; 70/288; 70/292; 70/441; 70/DIG. 49

[58] Field of Search ..... 70/287, 288, 292, 293, 70/294, 304, 312, 329, 423, 424, 425, 426, 427, 428, 441, DIG. 49

[56] References Cited

U.S. PATENT DOCUMENTS

| | | | |
|---|---|---|---|
| 33,933 | 12/1861 | Felter . | |
| 499,502 | 6/1883 | Beasley | 70/425 |
| 530,133 | 12/1894 | Smyth . | |
| 971,406 | 9/1910 | Remlinger . | |
| 1,380,260 | 5/1921 | Somora | 70/425 |
| 1,688,207 | 10/1928 | Del Rosso . | |
| 3,723,682 | 3/1973 | Pecott . | |
| 4,365,491 | 12/1982 | Rubinstein | 70/425 |

FOREIGN PATENT DOCUMENTS

| | | | |
|---|---|---|---|
| 58251 | 8/1891 | Fed. Rep. of Germany | 70/312 |
| 361009 | 10/1922 | Fed. Rep. of Germany | 70/425 |
| 752 | 7/1884 | Italy . | |
| 338842 | 3/1936 | Italy | 70/425 |
| 236909 | 3/1945 | Switzerland | 70/312 |

*Primary Examiner*—Robert L. Wolfe

*Attorney, Agent, or Firm*—Lilling & Greenspan

[57] ABSTRACT

The improved guard plate of this invention is used to protect the cylinder of a lock. It includes a relatively flat body, attached to the door in the vicinity of the cylinder, and a disc rotatably mounted between the door and the flat body. In an open position, an opening in the disc permits access to the cylinder; and, in the closed position, the solid portions of the disc do not permit access to the cylinder. In adition, rotatable fingers are provided so as to lock the rotatable discs in either the open or closed position. Further, a stud extends from each of the rotatable fingers into and through the door. On the end of each stud is an electrical contact which may come into intermittent contact with an electrical contact positioned on the inside surface of the door. Thus, rotation of the rotatable fingers in the incorrect direction or too far in the correct direction will cause touching of the two electrical contacts and completion of an electrical circuit which will activate an alarm.

2 Claims, 16 Drawing Figures

GUARD PLATE AND ALARM

This application is a continuation-in-part of application Ser. No. 147,623 filed May 7, 1980 and now U.S. Pat. No. 4,305,491.

BACKGROUND OF THE INVENTION

The guard plates presently used for protecting lock cylinders are generally disposed over the cylinder on the outside surface of the door. Such plates prevent intruders from penetrating the cylinder and thus opening the door.

One disadvantage of these guard plates is that the keyhole portion of the cylinder is still accessible to unwanted intruders. Thus, it is an object of this invention to provide a guard plate which will also cover the keyhole portion of the cylinder. In this way, the lock and its cylinder will be protected even more from tampering and from picking. Furthermore, the improved guard plate of this invention prevents glue or other foreign materials from getting into the keyhole or the cylinder itself.

Another feature of the invention is the inclusion of an alarm system. If an intruder attempts to open the guard plate in an incorrect manner, an alarm will sound, thus offering even more protection.

DETAILED DESCRIPTION OF THE INVENTION

Figure 1:
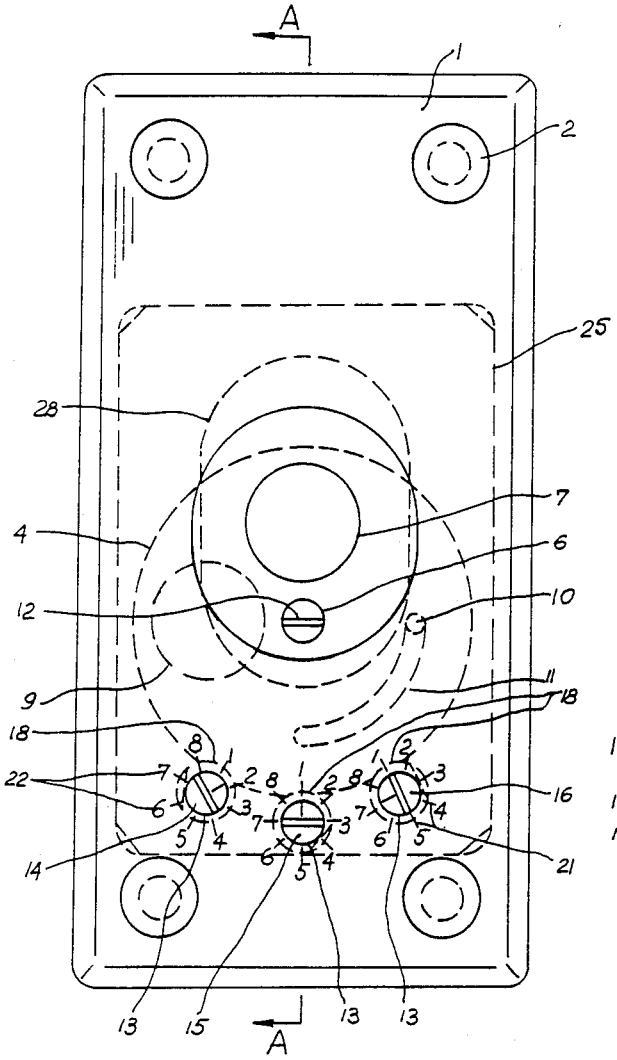
FIG. 1 is a front view of the improved guard plate in the closed position.
Figure 2:
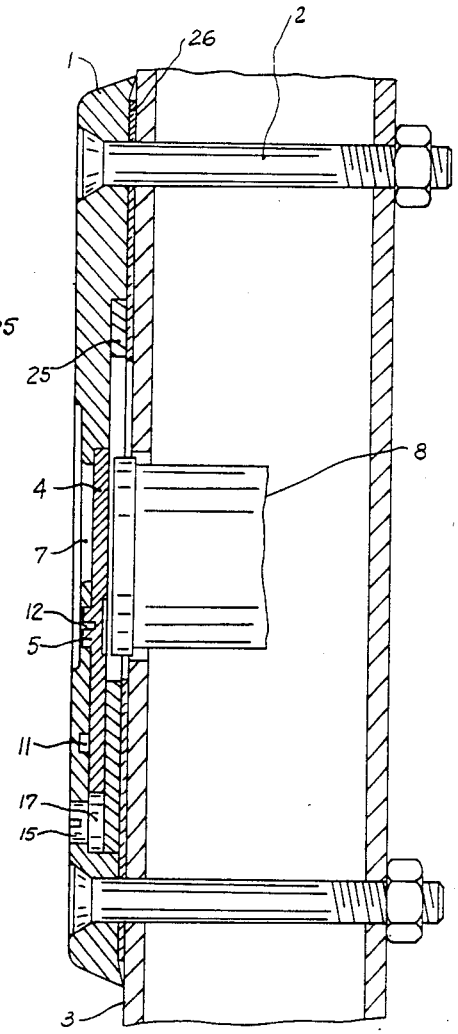
FIG. 2 is a cross-sectional view of the improved guard plate taken substantially along the lines A—A of FIG. 1.
Figure 6:
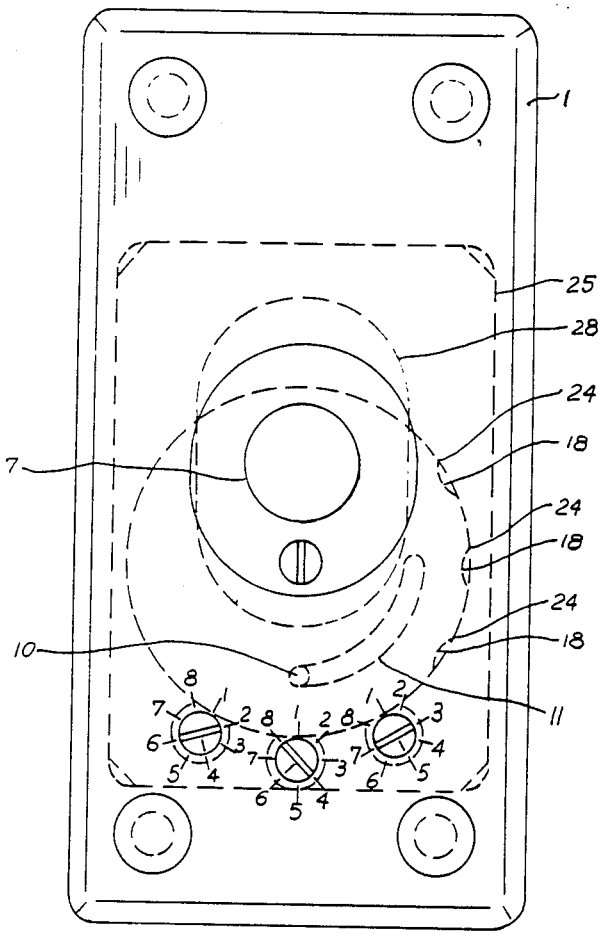
FIG. 6 is a front view of the guard plate in the open position.

As is best shown in FIGS. 1, 2 and 6, the improved guard plate includes a relatively flat body or plate 1, which is generally attached in a conventional manner to the outside surface of a door 3, such as by means of bolts

2. The body may be made from any strong material, but it is preferably made of metal. Further, a hole 7 is defined in the body 1 in order to provide access to the keyhole of the cylinder 8 of the lock.

Positioned between the flat body 1 and the outer surface of the door 3 is a rotatably mounted disc 4. In the approximate center of the disc 4 a short stem or nub 5 is provided. This stem 5 of the disc 4 may then be positioned within a second hole or opening 6 within the body 1. Thus, the hole or opening 6 acts as a sort of bushing and permits rotation of the disc 4. Further any other conventionally known methods of rotatably mounting the disc 4 may be provided. In the preferred embodiment, a slot 12 is provided on the front surface of the stem 5 (see FIG. 2). Then, a flat object, such as a special key-plate can be inserted into the slot 12 in order to rotate the disc 4. In some embodiments, the stem 5, and the slot 12, may be recessed-partially within the hole 6 of the body 1, or, in other embodiments, the stem 5 may extend completely through the hole 6 and extend outward from the body 1. In still other embodiments, it is possible to eliminate the slot 12 and merely extend the stem 5 through the hole 6 and to permit it to extend outward from the body 1. This way the stem can act as a sort of handle and may be easily rotated by the user's fingers.

On the inner surface of the body 1 a circular groove or slot 11 is preferably positioned. A stop 10 is positioned on the outer surface of the disc 4 so that it may move within the circular slot 11 as the disc is rotated. In other embodiments, it is possible to provide the stop on the body 1 and the groove or slot 11 on the disc 4. In addition, a hole or opening 9, approximately equal in size to the hole or opening 7 in the body 1, is made in the disc 4. In the open position of the guard plate (see FIG. 6), the disc 4 is set so that its opening or hole 9 is aligned with the hole 7 in the body and access is provided to the keyhole of the cylinder 8 of the lock. as can be seen, the stop 10 is at one extreme end of the circular slot 11 and further clockwise rotation of the disc 4 is not possible. In order to prevent access to the keyhole of the cylinder, the disc 4 is rotated in a counterclockwise direction. This causes the hole or opening 9 of the disc to move away from the hole or opening 7 in the body 1. Thus, the solid portions of the disc effectively close the hole or opening 7 in the plate and prevent access to the keyhole of the cylinder. During this rotation of the disc, the stop 10 moves in the circular slot 11 until it reaches the other extreme end of the slot (see FIG. 1). At this point, further rotation of the disc 4 is not possible and the hole 7 is completely covered by the solid portions of the disc 4 (see FIG. 1).

In order to prevent rotation of the disc 4 by intruders, a plurality of locking fingers 14, 15 and 16 are provided. The exact number of fingers provided is dependent on the degree of security desired. If more fingers are provided, then the guard plate will be more secure. Obviously, if less fingers are provided, the guard plate will be less secure. In the preferred embodiments, three fingers are provided, but is should be understood that any number of ingers may be used.

Through holes 13 are provided in the body 1 near the periphery of the disc 4. Then, the fingers 14, 15 and 16 are rotatably inserted into respective holes. Considering now the second finger 15 (see FIGS. 2 and 4), its construction will be considered, but it should be pointed out that the construction of all of the fingers is the same. The finger 15 is essentially round in shape with a circular flange 17 provided at its back end. Preferably the diameter of the flange 17 is greater than the respective through hole 13. This prevents the finger from being easily removed from the improved guard plate. The rounded portions of the flanges interact with respective circular grooves 18 located on the periphery of the disc 4. This effectively prevents rotation of the disc 4. The flange portion 17 of each of the fingers is further provided with cutoff portions 23. When the fingers are rotated so that the cutoff portions 23 are aligned with the respective grooves 18, the fingers no longer serve to prevent rotation of the disc 4.

Figure 3:
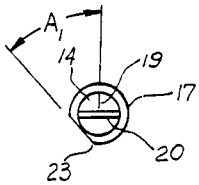
FIG. 3 is a front view of a first finger.
Figure 4:
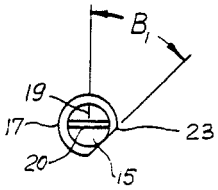
FIG. 4 is a front view of a second finger.
Figure 5:
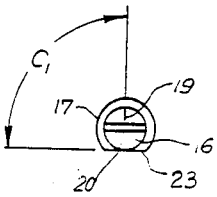
FIG. 5 is a front view of a third finger.
Figure 7:
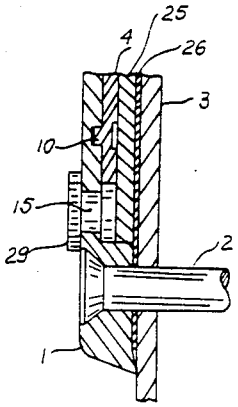
FIG. 7 is a view similar to FIG. 2, but showing another embodiment of the fingers.
Figure 10:
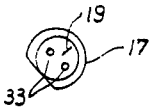
FIG. 10 is a front view of another embodiment of the fingers.

As best shown in FIGS. 3, 4 and 5, each of the fingers 14, 15 and 16 is provided with a slot 20 on its front face. A flat object, such as the special key-plate used to rotate the disc 4, may then be fitted into the slots 20 of the giners and used to rotate the fingers. If desired, the front face of the fingers may be recessed within the respective through holes 13. In other embodiments, it is possible for the fingers to extend through the holes 13 and extend outward from the body 1. In such a case, it may be desirable to provide an enlarged head 29 on the front face of the finger, in order to facilitate rotation of the fingers (see FIG. 7). Alternatively, in another embodiment of the fingers, small holes 33 may be provided on the front face of the fingers (FIG. 10). Then, the special key may be inserted into the holes to rotate the fingers. Furthermore, any other known method of rotating the fingers may be used.

It is preferable that alignment marks 19 be provided on the front faces of the fingers. In addition, additional alignment marks 21 should be placed on the surface of the body 1 near the fingers. Thus, when the fingers are rotated, the user knows that the cutoff portions 23 of the flange 17 will be aligned with the grooves 18 when the alignment mark 19 is aligned with a certain alignment mark 21. To facilitate this process of identifying the correct alignment mark 21, numbers 22 may be provided near the alignment marks 21. Then, the user of the improved guard plate may need only remember a simple combination for the fingers. In the emobodiments shown in this application (see FIG. 6), the combination is 4 6 5. As can be seen from FIGS. 3–5, the cutoff portions 23 of the flanges 17 of the fingers may be made at different angles to the alignment mark 19 of that finger. For example, the cutoff portion 23 of the finger 14 is at an angle A1 to the alignment mark 19, the cutoff portion 23 of the finger 15 is at an angle B1 to the alignment mark 19, and the cutoff portion 23 of the finger 16 is at angle C1 to the alignment mark 19. To change the combination of the guard plate, one merely has to reposition the fingers or to insert different fingers.

In some embodiments of the device, it may be desirable to eliminate the flange portion of the fingers. In such a case, one portion of the rounded fingers would be essentially flat. When this flat portion was aligned with the grooves 18, rotation of the disc 4 would be possible.

Because of the nature of this device, a high degree of accuracy in positioning the fingers is not nescessary in order to permit rotation of the disc 4. Thus, if only a portion of the cutoff portion 23 is within the circular groove, rotation of the disc 4 will cause the corner 24 of the groove 18 to rotate the finger until the entire cutoff portion 23 is aligned with the groove 18. Thus, a high degree of accuracy in placing the alignment marks 19 and 21 is not required.

In the preferred embodiments, a backing plate 25 may be inserted between the rotatable disc 4 and the door 3. This plate would be used to keep the disc 4 securely against the inner surface of the body 1. In addition, an elastic spacer 26 may then be provided between the plate 25 and the outer surface of the door 3. The plate 25 has an opening 28 within which the cylinder 8 is aligned. Obviously, the elastic spacer 26 must also have an opening within which the cylinder 8 may be positioned.

Figure 8:
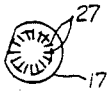
FIG. 8 is a back end view of an alternate emobdiment of the fingers.

In order to provide for more accurate positioning of the fingers, teeth 27 may be provided on the back end of the flange 17 (see FIG. 8). A matching set of teeth would then be provided on the plate 25. In the normal position, these teeth would prevent easy rotation of the fingers. During intended rotation of the fingers, inward pressure of the fingers would cause the plate 25 to be moved toward the door, because of the action of the elastic spacer 26, and the fingers would be permitted to rotate to a certain extent. Thus, more accurate alignment of the alignment marks 19 and 21 may be provided.

Figure 9:
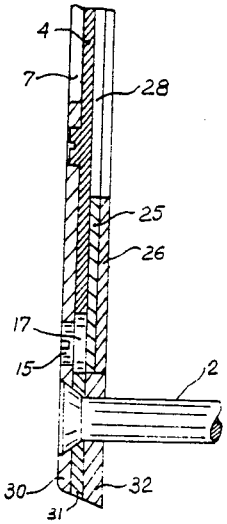
FIG. 9 is a view similar to FIGS. 2 and 7, but showing another embodiment of the body.

In still another embodiment (see FIG. 9), the body 1 may be made of three plates 30, 31 and 32. The outer plate 30 is essentially flat and is provided with a hole 7 to provide access to the cylinder 8. Further, this outer plate 30 has the opening 6 into which the stem 5 of the disc 4 is positioned. The middle plate 31 has a circular recess 34 into which the disc 4 may be positioned. In addition, the middle plate 31 has circular recesses 35 into which the flange portion 17 of the fingers may be positioned. The inner plate 32 is provided with a substantially rectangular recess 36 into which the backing plate 25 may be positioned.

Figure 11:
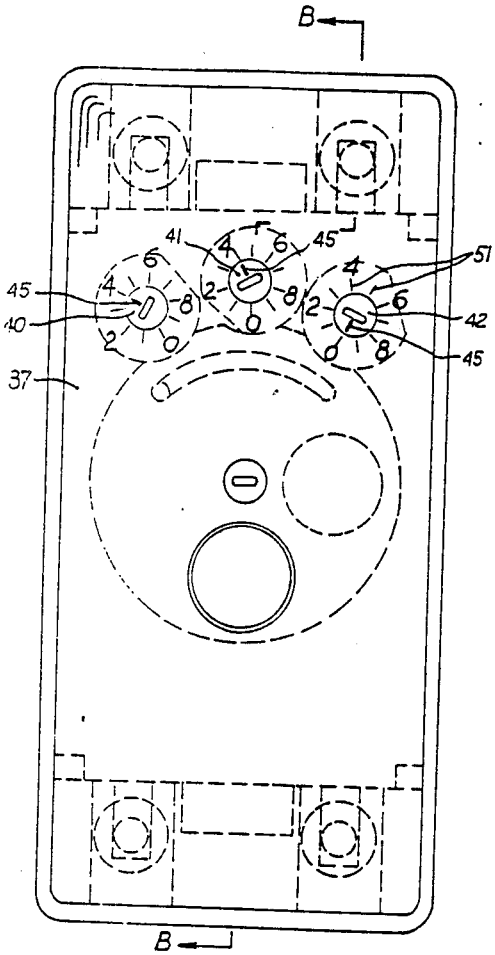
FIG. 11 is a front view of another embodiment of the invention, wherein the alarm system is provided.
Figure 12:
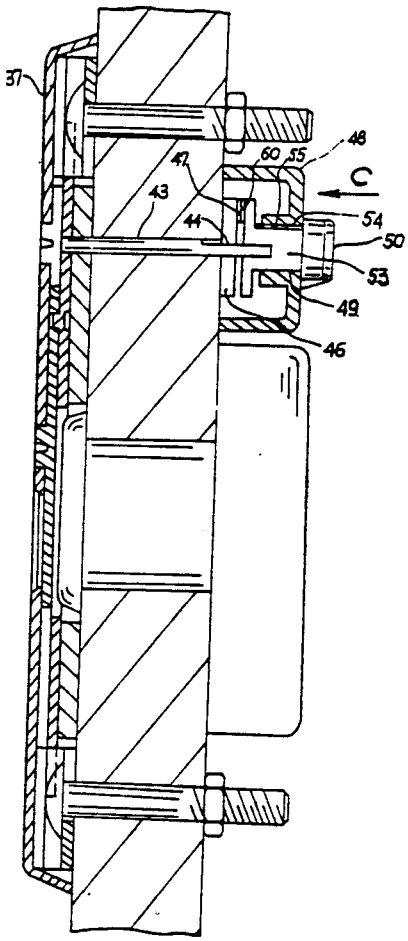
FIG. 12 is a cross-sectional view taken substantially along the lines B—B of FIG. 11.

Referring now to FIGS. 11 and 12, the fingers 40, 41 and 42 are provided with long and relatively thin studs 43; the studs 43 pass through appropriate openings in the guardplate and in the door and extend through the inside surface of the door. The distal end of each of the studs 43 has a flat portion 44, which is, at all times, in alignment with the alignment mark 45 on the face of the respective finger. A plate 46 for each finger is held in position by the flat portion 44 of the respective finger. Each of the plates 46 has an electrical contact 47 which is in substantial alignment with the alignment mark 45. Because of the construction of the pieces, rotation of the finger will causes rotation of the contact 47, and the contact 47 will be in the same position as the alignment mark 45.

Figure 13:
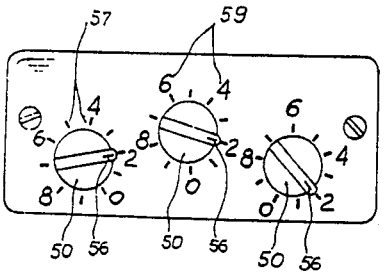
FIG. 13 is a view taken in the direction of arrow C in FIG. 12, and showing the contact box.

Referring now to FIGS. 12 and 13, a contact box is provided on the inside surface of the door and it includes a casing or body 48. The aforementioned studs extend into this casing 48, and the flat portions 44 and the plates 46 rotate within the casing 48. In alignment with each of the studs 43 is an opening in the casing 48. Tumblers 50 are inserted into the openings 49 and are in alignment with a respective stud 43. On the casing 48 around the periphery of each of the tumblers 50 marks 57 with numbers 59 are placed, and these marks are in alignment with the alignment marks 51 on the face of the body 37 for the respective finger. Further, each of the tumblers is inserted into the respective openings 49 in order to permit rotation of the tumbler. A spring acting portion 53 of the tumbler 50, small axial grooves 54 in the openings 49 and small axial projections 55 on the portion 53 permit the exact positioning of the tumbler 50.

Moreover, each of the tumblers 50 has two axial positions, i.e. a push position or a pull position. Inside the casing 48 each of the tumblers 50 has an electrical contact 60 on its surface, and the electrical contact 60 is in alignment with the mark 56 on the surface of the tumbler 50. The push position of the tumbler 50 is the working position of the alarm. In this position, the electrical contact 60 on the inner surface of the tumbler 50 can come into momentary contact with the electrical contact 47 when a respective finger is rotated. In the pull position, the contacts 60 and 47 do not touch when the fingers are rotated.

Figure 14:
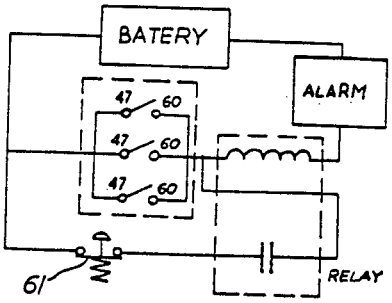
FIG. 14 is an electrical schematic diagram, showing the circuitry in the contact box.

FIG. 14 shows the electrical connections inside the contact box. When the electrical contacts 47 and 60 for any one of the fingers come into contact, the circuit is completed and an alarm is sounded. A button or other switch 61 may be provided to disconnect the circuit after the alarm has been sounded.

In order to operate the alarm, the tumblers are moved into the push position—which is the operating position. The tumblers are rotated to a certain position, which is selected by the user. This position is determined according to the "combination" of the fingers on the surface of the guard plate. The "combination" of the tumblers 50 is determined, so that rotation of the fingers to the correct combination does not cause contact between the electrical contacts 47 and 60. In other words, since the user knows the combination of the tumblers 50, he must make certain that he does not turn the combination of the fingers to that combination, otherwise the electrical contacts 47 and 60 will come into contact and complete the circuit and sound the alarm. Thus, if someone does not know the combination of the fingers, such person would turn the fingers too far, or in the wrong direction, and there will be communication between the electrical contacts 47 and 60 and the alarm will be sounded. Furthermore, as is apparent from FIG. 14, each of the sets of contacts 47 and 60 are connected in parallel, so that only one of the fingers has to be turned too far before an alarm will be sounded.

Figure 15:
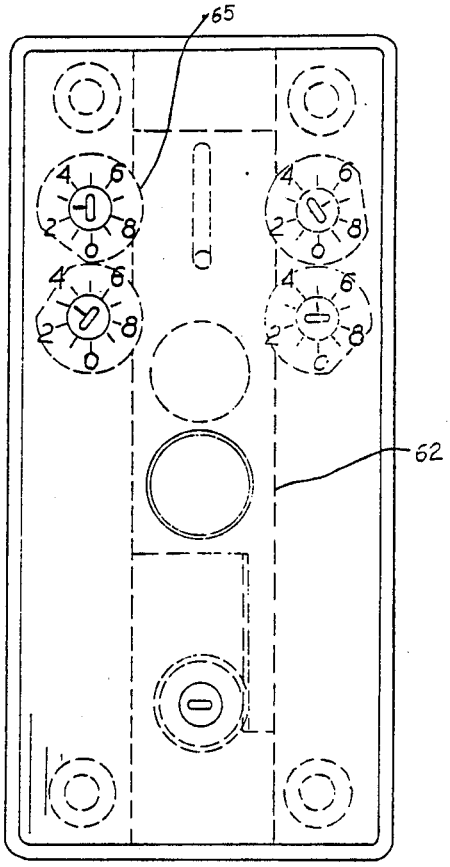
FIG. 15 is a front view of an alternate embodiment of the improved guard plate, wherein the cylinder cover moves vertically.
Figure 16:
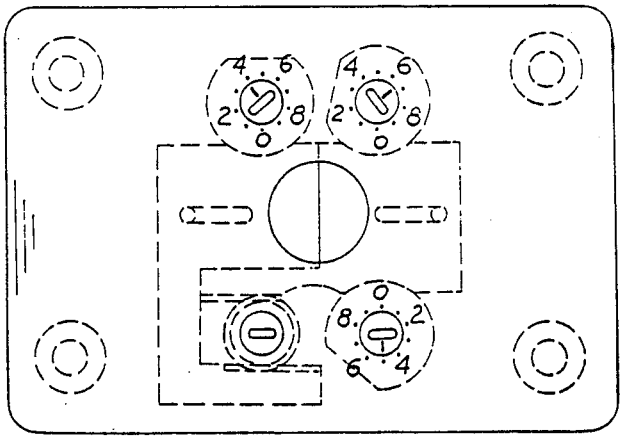
FIG. 16 is a front view of an alternate embodiment of the improved guard plate, wherein the cylinder cover moves horizontally.

FIGS. 15 and 16 show two other possible embodiments of the invention. Instead of a rotatably mounted disc being used to cover the keyhole, a strip or place is used to cover the keyhole and it is moved either vertically (FIG. 15) or horizontally (FIG. 16) to cover the keyhole. In all other respects, these embodiments operate the same as the embodiments shown in FIGS. 1–10. Grooves 65 on the surface of the strip 62 align with the fingers to prevent movement of the strip and, when the fingers are rotated an appropriate amount, the strips are able to move. The linear motion of the strip or plate 62 can be effected either by a toothed rack and gear (as shown in FIG. 15), or by a cam (not shown), or by two linear motion plates (as shown in FIG. 16), or in any other known manner.

We claim:

1. An improved guard plate and alarm for protecting a cylinder of a lock, comprising: a body attached to the door in the vicinity of the cylinder, said body having a first opening in alignment with cylinder; a cylinder cover movably mounted on an inside surface of said body between said body and said door, said cylinder cover having an opening approximately equal in size to said first opening of said body; means for moving said cylinder cover positioned on a surface of said cylinder cover and being accessible through a second opening in said body; at least one substantially round finger including a cutoff portion, rounded portions of each finger interacting with a respective groove made on the periphery of said cylinder cover to prevent rotation of said cylinder cover, rotation of each finger causing said rounded portions to move away from respective grooves and causing said cutoff portions to become aligned with said respective hollow grooves, thereby permitting movement of said cylinder cover, and each finger being rotatably inserted in a respective third opening in said plate; at least one stud extending from each finger into and through the door, each stud having an electrical contact on a distal portion; at least one tumbler positioned on an inside surface of said door, each tumbler having an electrical contact positioned for occasional contact with the electrical contact on said distal end of a respective stud; and an electrical circuit including a power means, an alarm means and said electrical contacts, such that the touching of the electrical contact on the distal end of a stud with the electrical contact on a respective tumbler closes said electrical circuit and activates said alarm.

2. An improved guard plate and alarm according to claim 1, wherein the distal end portion of each stud is flat and a plate is fixed to the said flat portions, the electrical contact on the end of said stud being positioned on the plate.

* * * * *